US007712735B2

(12) United States Patent
Chorier-Pichon et al.

(10) Patent No.: US 7,712,735 B2
(45) Date of Patent: May 11, 2010

(54) DEVICE FOR UNSTACKING POSTAL ITEMS WITH OPTIMIZED MANAGEMENT OF UNSTACKING CONDITIONS

(75) Inventors: Pierre Chorier-Pichon, Romans (FR); Stephane Ambroise, Valence (FR); Stephane Samain, Chabeuil (FR)

(73) Assignee: Solystic, Gentilly Cedex (FR)

( * ) Notice: Subject to any disclaimer, the term of this patent is extended or adjusted under 35 U.S.C. 154(b) by 83 days.

(21) Appl. No.: 11/858,468

(22) Filed: Sep. 20, 2007

(65) Prior Publication Data

US 2008/0073827 A1 Mar. 27, 2008

(30) Foreign Application Priority Data

Sep. 21, 2006 (FR) ..... 06 53854

(51) Int. Cl.
*B65H 1/18* (2006.01)

(52) U.S. Cl. ..... 271/153; 271/149; 271/150; 271/157; 271/158; 271/159; 271/213; 271/214; 414/795.2; 414/795.7

(58) Field of Classification Search ..... 271/149, 271/150, 153, 157, 158, 159, 213, 214; 414/795.2, 414/795.7

See application file for complete search history.

(56) References Cited

U.S. PATENT DOCUMENTS 3,598,399 A * 8/1971 Cottrell ..... 271/146
4,934,682 A * 6/1990 Rece et al. ..... 271/3.12
5,299,797 A * 4/1994 Ricciardi ..... 271/150
5,360,316 A * 11/1994 O'Mara et al. ..... 414/798.9
5,379,992 A * 1/1995 Holmes et al. ..... 271/2
5,957,448 A * 9/1999 Frank et al. ..... 271/152
6,003,857 A 12/1999 Salomon et al.
6,805,343 B2 * 10/2004 Kosugi ..... 271/147
7,195,236 B2 * 3/2007 Hillerich et al. ..... 271/2
7,467,792 B2 * 12/2008 Bittenbender et al. ..... 271/149
2002/0153654 A1 * 10/2002 Blackwell et al. ..... 271/96
2003/0025266 A1 * 2/2003 Stevens ..... 271/149
2006/0197272 A1 * 9/2006 Hendricks et al. ..... 271/31
2007/0252321 A1 * 11/2007 Kutzer et al. ..... 271/34

* cited by examiner

*Primary Examiner*—Patrick H Mackey
*Assistant Examiner*—Prasad V Gokhale
(74) *Attorney, Agent, or Firm*—Rothwell, Figg, Ernst & Manbeck, P.C.

(57) ABSTRACT

An unstacker device for unstacking flat objects comprises a motor-driven feed magazine controlled so as to move flat objects in a stack and on edge facing an unstacking head provided with a motor-driven drive having a perforated belt and a suction chamber, which motor driven drive is actuated so as to separate a current first object from the stack and so as to eject it in a direction that is transverse to the direction in which the stack of flat objects is moved, in which device the motor-driven drive is actuated and stopped each time a current object is unstacked, and the stack of flat objects is straightened up in the magazine in response to detection of signals delivered by a plurality of sensors disposed in the unstacking head. The sensors are disposed in the unstacking head in a manner such as to deliver signals indicating that the current object is presented appropriately relative to the unstacking head, and the drive of the unstacking head is actuated if the signals indicate that the current object is presented appropriately.

11 Claims, 7 Drawing Sheets

FIG_12

3

| | 20 | 21 | 22 | 23 | 24 | Conveyor belt 2 | Paddle 4 | Secondary conveyor belts 12 |
|---|---|---|---|---|---|---|---|---|
| | 0 | 1 | 0 | 1 | 1 | 0.096 m/s | 0.096 m/s | 0.152 m/s |
| | 1 | 1 | 0 | 1 | 1 | 0.096 m/s | 0.096 m/s | Interrupt |
| | 0 | 0 | 0 | 1 | 1 | 0.096 m/s | 0.096 m/s | 0.152 m/s |
| | 1 | 0 | 0 | 1 | 1 | 0.096 m/s | 0.096 m/s | Reverse at 0.152 m/s |
| | 0 | 1 | 1 | 0 | 1 | Interrupt for 25 ms then 0.096 m/s | 0.096 m/s | 0.152 m/s |
| | 1 | 1 | 1 | 0 | 1 | Interrupt for 25 ms then 0.096 m/s | 0.096 m/s | Interrupt |
| | 0 | 0 | 1 | 0 | 1 | 0.096 m/s | 0.096 m/s | 0.152 m/s |
| | 0 | 0 | 1 | 1 | 0 | 0.096 m/s | 0.096 m/s | 0.152 m/s |
| | 1 | 0 | 1 | 1 | 0 | 0.096 m/s | 0.096 m/s | Reverse at 0.152 m/s |
| | 0 | 0 | 1 | 1 | 1 | 0.096 m/s for 25 ms | 0.096 m/s for 25 ms | 0.152 m/s |
| | 1 | 0 | 1 | 1 | 1 | 0.096 m/s for 25 ms | 0.096 m/s for 25 ms | Reverse at 0.152 m/s |

DEVICE FOR UNSTACKING POSTAL ITEMS WITH OPTIMIZED MANAGEMENT OF UNSTACKING CONDITIONS

FIELD OF THE INVENTION

The invention relates to an unstacker device for unstacking flat objects, which device comprises a motor-driven feed magazine controlled so as to move flat objects in a stack and on edge facing an unstacking head provided with a motor-driven drive. The motor-driven drive, which includes a perforated belt and a suction chamber, is actuated so as to separate a current first object from the stack and so as to eject it in a direction that is transverse to the direction in which the stack of flat objects is moved.

BACKGROUND OF THE INVENTION

The invention relates more particularly to a device for unstacking postal items, such as letters and large-format flat objects or "flats", in a postal sorting machine, for example.

Patent Document FR 2 797 856 discloses a device for unstacking postal items that is provided with a main magazine 1 having a belt. As shown in FIG. 1, the main magazine 1 comprises, in particular, a motor-driven conveyor belt 2 on which an operator disposes the postal items 3 in a stack and on edge, and a paddle 4 that is also motor-driven, that extends in a substantially vertical plane, and that is moved so as to push the back of the stack in the direction indicated by the arrow 6 facing the unstacking head 5.

The postal items in the stack are held laterally by a jogger edge 7 that extends in a substantially vertical plane along one edge of the conveyor belt 2. The substantially plane unstacking head 5 extends in a vertical plane that is transverse to the direction that is indicated by the arrow 6 and in which the stack of postal items 3 moves on the conveyor belt 2, and said unstacking head is suitable for separating the current first postal item at the front of the stack in the transverse direction indicated by the arrow 8 that is perpendicular to the arrow 6.

The unstacking head 5 is provided with two substantially rectangular openings in which a perforated belt 9 and one or more suction chambers or suction nozzles (not shown) are driven by motors, which openings co-operate to take hold of the first postal item in the stack by suction and to move it in the direction indicated by the arrow 8.

In operation, the stack of postal items 3 disposed in the main magazine 1 is moved by the stepper-type motor-driven drives of the conveyor belt 2 and of the paddle 4, which drives are actuated at the same speed. The first postal item at the front of the stack of postal items is thus brought into abutment against the unstacking head 5 so that that current postal item of the stack is caused to bear against the unstacking head 5 and is separated from the stack by the combined effect of the suction from the nozzles and of the movement of the perforated belt 9. The postal item is then nipped between two deformable wheels 10 disposed in alignment with the head 5. Said wheels 10 are motor-driven so as to propel the current postal item downstream from the unstacker device. They are made of an elastically deformable elastomer material so that they are suitable for adapting to accommodate various thicknesses of postal item.

For the remainder of the sorting process, it is necessary for the postal items to be put into series on exiting from the unstacker device with a constant pitch between consecutive postal items. The drives of the perforated belt 9 and of the suction nozzles are thus actuated and stopped at a constant rate.

That processes of unstacking is repeated as another postal item at the front of the stack is presented facing the unstacking head 5.

In the device of Document FR 2 797 856, the postal items from the stack are put into series continuously, i.e. at a constant unstacking rate.

In general in a postal sorting machine, the postal items exiting from the unstacker are conveyed in series and on edge so as to be taken past a read head. The read head acquires an image of each postal item in the series for the purpose of automatically decoding the inward sorting or outward sorting address of the postal item by means of Optical Character Recognition (OCR) processing. The postal items are then directed to the sorting outlets corresponding to the automatically decoded addresses.

In that type of unstacker device it has been observed that a significant proportion of postal items are not appropriately presented facing the unstacking head while they are being unstacked and might therefore be damaged or torn, e.g. on being engaged by the wheels 10. Such postal items might even cause a jam in the unstacker device, requiring a maintenance operator to take action and the unstacker device to be stopped. Such action is costly and slows down the overall sorting process. Such a situation can be particularly frequent with open postal items of the advertising brochure type or of the magazine type, etc.

Patent Document EP 0 562 954 presents a solution to that problem. In that document, the feed device of the unstacker is similar to the above-described device but further comprises a motor-driven drop-forming feed. The motor-driven drop-forming feed is disposed between the conveyor belt and the unstacking head. The effect of the presence of said motor-driven drop-forming feed is to fan out some of the first postal items (those postal items that are in the drop-forming feed), thereby resulting in the first postal item at the front of the stack being parted from the other postal items and thus finding it easier to be presented appropriately against the unstacking head 5.

In Document EP 0 562 954, presence sensors are provided that are disposed so as to detect a certain inclination of fanning of the postal items in the drop-forming feed and also so as to detect the level of filling of the drop-forming feed. In response to the signals delivered by the sensors, the motor-driven drop-forming feed and/or the conveyor belt are actuated so as to fill the drop-forming feed and/or so as to incline the postal items appropriately.

However, the above-indicated features do not completely eliminate situations in which the postal items are damaged or situations in which a jam forms in the unstacker device, e.g. when very flexible postal items tend to collapse in the drop-forming feed.

Patent Document WO 2005/042386 describes a postal item unstacker device of the "shingler" type that is provided with a main magazine comprising a main conveyor belt and a paddle, and a secondary conveyor belt disposed between the main conveyor belt and the unstacking head. The unstacking head includes a belt having a motor-driven drive that is actuated so as to separate a current first postal item from the stack and so as to eject said postal item in a direction that is transverse to the direction of movement of the postal items. In an unstacker device of the shingler type, the belt of the unstacking head does not co-operate with a suction chamber since the postal items are displaced one on another so as to form a shingle pattern during the unstacking process.

In Document WO 2005/042386, sensors disposed in the unstacking head make it possible to detect the inclination of the current postal item to be unstacked and, in response to the signals delivered by its sensors, the main conveyor belt, the paddle, or the secondary conveyor belt are controlled so as to correct the inclination. In addition, the motor-driven drive of the unstacking head is actuated and stopped in a manner such as to obtain a constant pitch between postal items at the outlet of the unstacker device.

With the device of Document WO 2005/042386, postal item damage situations or jam situations are still too many.

Document US 2002/153654 also discloses a device for unstacking flat objects with presentation control means for controlling how the objects are presented facing an unstacking head, that device being provided with one or two sensors disposed in the unstacking head. Said control means stop the unstacking head when the one or two sensors determine inappropriate presentation of an object. Unstacking of said object is actuated when the presentation of the object becomes appropriate, after the presentation of the object has been corrected. However, with that device, an unacceptable number of postal items are damaged and jam situations are frequent.

OBJECTS AND SUMMARY OF THE INVENTION

An object of the present invention is thus to improve further a device for unstacking flat objects so as to avoid said flat objects being damaged and so as to avoid the unstacker device jamming.

To this end, the invention provides an unstacker device for unstacking flat objects, which device comprises a motor-driven feed magazine controlled so as to move flat objects in a stack and on edge facing an unstacking head provided with a motor-driven drive having a perforated belt and a suction chamber, which motor driven drive is actuated so as to separate a current first object from the stack and so as to eject it in a direction that is transverse to the direction in which the stack of flat objects is moved, in which device the motor-driven drive is actuated and stopped each time a current object is unstacked, and the stack of flat objects is straightened up in the magazine in response to detection of signals delivered by a plurality of sensors disposed in the unstacking head, wherein said sensors are disposed in the unstacking head in a manner such as to deliver signals indicating that said current object is presented appropriately relative to the unstacking head, and wherein the drive of the unstacking head is actuated if the signals indicate that the current object is presented appropriately.

With this arrangement, it can be understood that the current postal item in a stack of postal items can be unstacked only when said current postal items is presented appropriately relative to the unstacking head, thereby making it possible to avoid situations in which the postal items are damaged and/or jam the device.

The unstacker device of the invention may include the following features:

- the plurality of sensors includes a first sensor disposed in the unstacking head to detect presence of a bottom portion of the current object facing the unstacking head;
- the plurality of sensors includes a second sensor disposed in the unstacking head to detect presence of a first intermediate portion of the current object facing the unstacking head, said first intermediate portion being situated above said bottom portion of the current object;
- the plurality of sensors includes a third sensor disposed in the unstacking head to detect presence of a second intermediate portion of the current object facing the unstacking head, said second intermediate portion being situated above said first intermediate portion of the current object; and
- the plurality of sensors further includes a fourth sensor disposed to detect presence of a flat object in said direction that is transverse to the direction in which the stack of flat objects moves.

In a particular embodiment of the invention, the first sensor is a flag mechanical sensor, the second sensor is a reflection optical sensor, the third sensor is a reflection optical sensor, and the fourth sensor is an optical barrier sensor, and the first, second, and third sensors are aligned vertically in the unstacking head.

In a particular embodiment of the invention, the feed magazine comprises a drop-forming feed disposed between a main conveyor belt with a motor-driven drive and the unstacking head, and a paddle with a motor-driven drive, said paddle being suitable for being moved along the main conveyor belt, the drop-forming feed being provided with secondary conveyor belts with a motor-driven drive, the control unit acting on the motor-driven drives of the main conveyor belt, of the paddle, and of the secondary conveyor belts so as to present the current object appropriately relative to the unstacking head.

It should be understood that the main conveyor belt, the motor-driven paddle, and the secondary conveyor belts in the drop-forming feed are designed to be controlled asynchronously by the control unit which is also arranged to change the speeds and the directions of the motor-driven drives of the feed magazine in order to present the current object appropriately.

In another particular embodiment of the invention, the control unit is arranged to trigger an alarm at the end of a certain lapse of time for which the control unit has been acting on the motor-driven drives of the main conveyor belt, of the paddle, and of the secondary conveyor belts without obtaining appropriate presentation of the current object relative to the unstacking head.

The invention also provides a machine for handling postal items, said machine including such an unstacker device.

The feed device of the invention is applicable to flat objects, e.g. to small-format and large-format flat postal items, but it can also be applied to fields for handling other flat objects such as books, checks, or other objects.

BRIEF DESCRIPTION OF THE DRAWINGS

The invention can be understood more clearly on reading the following description with reference to the drawings. The description is given merely by way of indication that in no way limits the invention. In the drawings:

FIG. 12 is a table showing the signals from the sensors detecting an inappropriate presentation of the current postal item to be unstacked.

FIG. 1 is presented in the above description of the prior state of the art.

FIG. 2 thus shows an unstacker device 1 of the invention for unstacking postal items such as letters and large-format flat postal items or "flats", the elements that are in common with the device of FIG. 1 bearing identical numerical references.

MORE DETAILED DESCRIPTION

Figure 1:
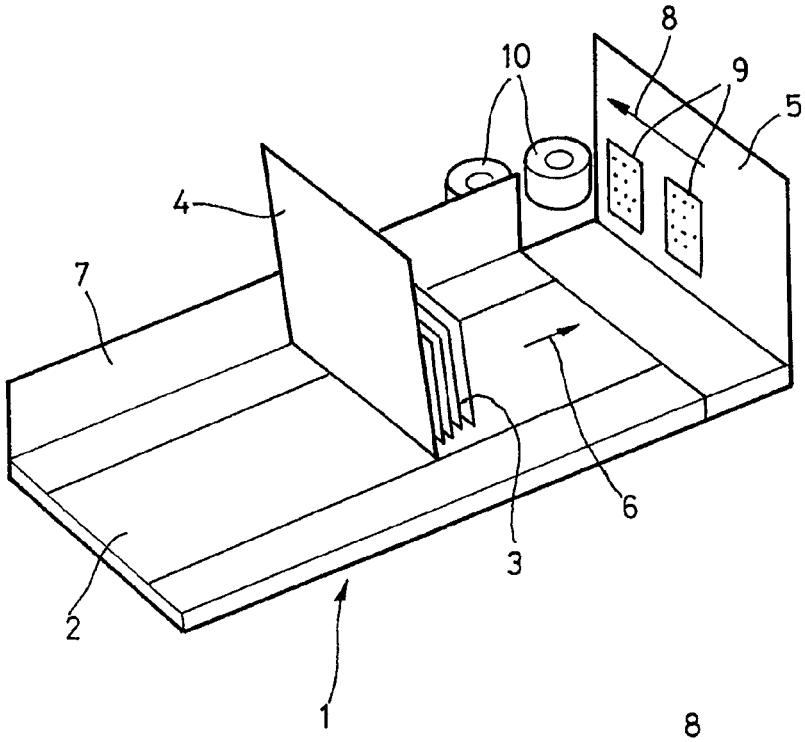
FIG. 1 diagrammatically shows a feed device for a prior art unstacker for unstacking flat postal items.

The unstacker device serves to put the postal items into series upstream from conveyor belts, in which series of postal items the postal items are separated in pairs with a normally constant pitch. The motor-driven deformable wheels 10 between which the postal items put into series are nipped can be caused to be driven at variable speed so as to take up differences in pitch between consecutive postal items, where necessary. This variable-speed arrangement constitutes a synchronization system that guarantees a constant pitch.

Advantageously, the synchronization system authorizes certain correction operations to be performed during a time window T compatible with the requirement for constant pitch between consecutive items at the outlet of the unstacker device.

The unstacker device 1 includes a main feed magazine 1 with a motor-driven conveyor belt 2 on which postal items 3 are disposed in a stack and on edge in front of a motor-driven paddle 4 that extends substantially in a vertical plane while being slightly inclined so as to support the back of the stack of postal items.

The conveyor belt 2 and the paddle 4 move the stack of postal items 3 on edge towards the unstacking head 5 in the direction 6.

A jogging edge 7 against which the side edges of the postal items are aligned is also shown along the conveyor belt 2.

Figure 2:
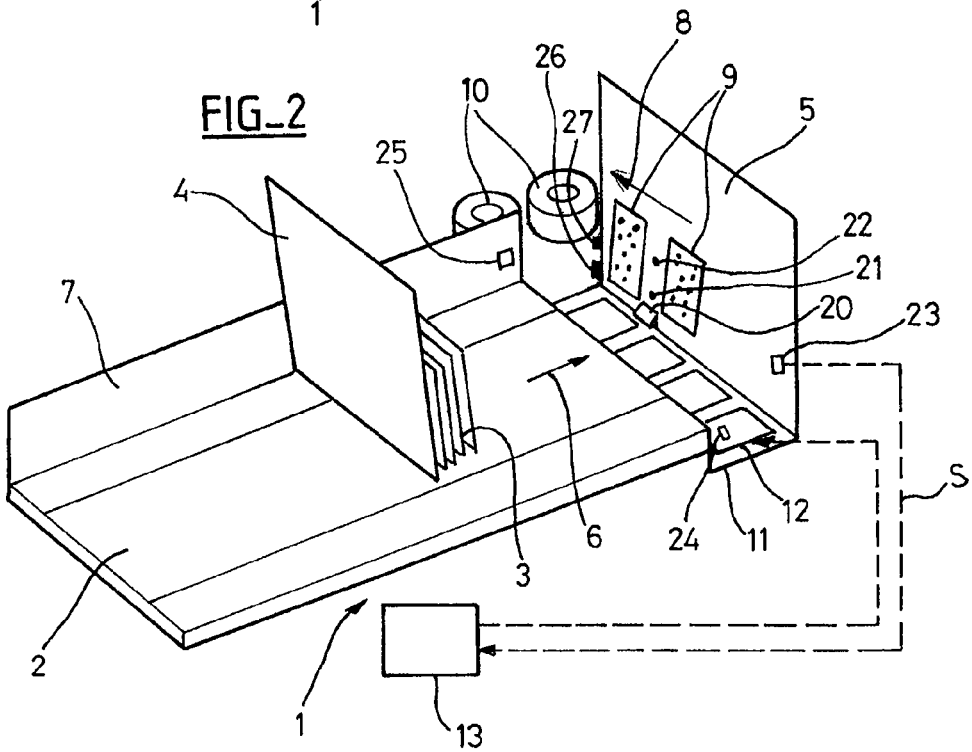
FIG. 2 diagrammatically shows a feed device for an unstacker of the invention for unstacking flat postal items.

FIG. 2 shows a channel-shaped drop-forming feed 11 constituting a secondary feed magazine between the end of the main conveyor belt 2 and the unstacking head 5. The bottom of the drop-forming feed 11 is situated at a distance of about 100 millimeters (mm) below the top surface of the conveyor belt 2 and has a width of about 98 mm in the direction 6.

The bottom of the drop-forming feed 11 is provided with a set of motor-driven secondary conveyor belts 12, e.g., as in this example, four conveyor belts, which secondary conveyor belts move the postal items on edge inside the feed in direction 6 towards the unstacking head 5.

The motor-driven unstacking head 5 extends vertically from the bottom of the drop-forming feed 11 to a sufficient height corresponding to at least the maximum height of the postal items to be unstacked.

The unstacking head 5 in the form of a metal sheet is, in this example, provided with two rectangular openings disposed side-by-side in the direction 8. In each of the openings, an endless perforated belt 9 co-operates with suction chambers or suction nozzles (not shown) to take hold of a current postal item from the stack that is facing the head, and to move said current postal item in the direction 8.

In accordance with the invention, the motor-driven drives for driving the conveyor belt 2, the paddle 4, the secondary conveyor belts 12, and the unstacking head (perforated belts 9 and suction nozzles) are designed to be controlled independently from one another, but naturally they can be controlled in a manner such as to be synchronized relative to one another by a control unit 13, e.g. a programmable data processor.

In FIG. 2, for reasons of clarity, only one monitoring/control link is shown between the control unit 13 and a conveyor belt 12, but naturally the unit 13 is also connected by monitoring/control links to the respective motor-driven drives of the conveyor 2, the paddle 4, and of the belts 9 (and suction nozzles).

In accordance with the invention, the unstacker device is provided with a set of sensors, each of which delivers a detection signal to the control unit 13. In FIG. 2, also for reasons of clarity, only one monitoring link is shown between the control unit 13 and a sensor, but naturally the unit 13 is also connected by monitoring links to the other sensors used in accordance with the invention as described below.

More particularly, FIG. 2 shows first sensors 20, 21, and 22 that are disposed in vertical alignment in the unstacking head 5, and, in this example, between the two openings in the head, in which openings the perforated belts 9 act.

The sensor 20 that is disposed lowest in the unstacking head 5 at the bottom of the drop-forming feed 11 is, in this example, a flag mechanical sensor in the form of a finger that is retractable into the thickness of the head 5 for the purpose of detecting the presence of a postal item facing the lowest portion (bottom) of the head 5.

Figure 4:
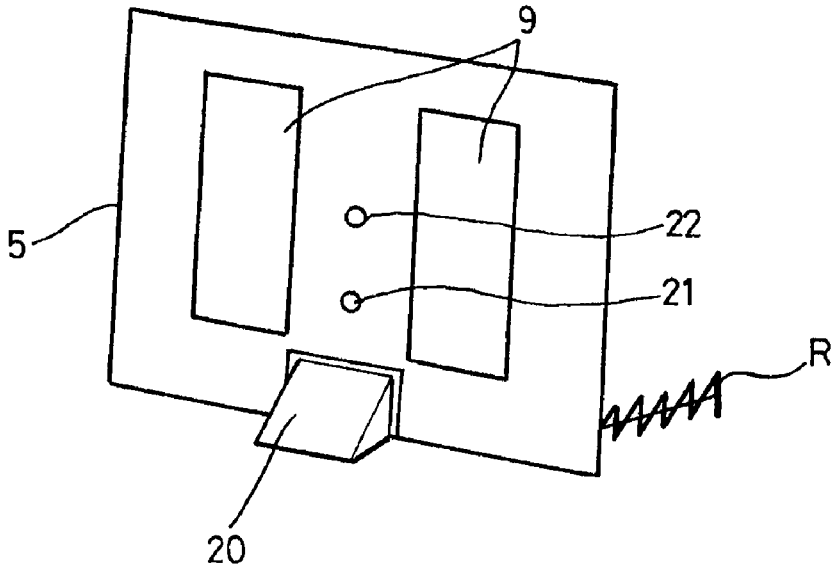
FIG. 4 diagrammatically shows the unstacking face with the sensors, including the flag mechanical sensor.

The sensor 20 is shown in more detail in FIG. 4. It delivers a signal indicating the presence of a postal item when it is retracted far enough into the head under the effect of the thrust from the base of the current postal item in the direction 6, which current postal item is itself pressed by the stack of postal items bearing against one another in the drop-forming feed 11. More particularly, in the rest position, the sensor 20 has a free end that projects relative to the unstacking head and that has a bevel-shaped profile flaring in the direction 6 and whose flat portion comes flush with the bottom of the drop-forming feed 11. The sensor 20 moves in the direction 6 against the drive from a return spring R, and the signal that it delivers, when it is retracted into the unstacking heads 5, can also indicate the distance over which it has retracted relative to its rest position, and thus indicate a pressure magnitude. It can be seen in FIG. 4 that said sensor is disposed below the bottom line of the perforated belts 9.

The sensor 20 is adapted to measure the pressure exerted by the set of postal items in the drop-forming feed at the bases of the postal items. A pressure of 0.3 newtons from the bases of the postal items against the unstacking head fans the postal items in the drop-forming feed out into a fan that is upwardly open. Fanning out the postal items facilitates separating them and reduces the rate of occurrences of postal items being taken in bunches instead of one-by-one. Provision can be made to monitor the pressure from the bases of the postal items, and said pressure can be adjusted by feeding the drop-forming feed 11 with postal items.

The sensor 21 is a reflection photoelectric cell disposed vertically above the sensor 20, e.g. 20 mm from the bottom of the drop-forming feed, for detecting presence of a current postal item facing a first intermediate portion of the head above the bottom portion of the head.

The sensor 22 is a reflection photoelectric cell disposed vertically above the sensor 21, e.g. 90 mm from the bottom of the drop-forming feed, for detecting the presence of a current postal item facing a second intermediate portion of the head above the first intermediate portion. As shown in FIG. 4, the two intermediate portions are at the same level as the perforated belts 9.

The sensors 20 and 21 are set so that each of them delivers a signal indicating presence of a postal item when said postal item is at a distance less than about 4 mm from the head 5 in the direction 6.

The sensor 22 is set to deliver a signal indicating presence of a postal item when said postal item is at a distance less than about 8 mm from the head 5 in the direction 6.

It can thus be understood that the signals delivered by the sensors 20 to 22 normally indicate together the presentation of the current postal item to be unstacked relative to the unstacking head.

FIG. 2 also shows three other sensors 23, 24, and 25.

The sensor 23 is a barrier photoelectric cell that operates along the unstacking head 5 and whose beam is directed to cross the face of a postal item. Said beam is launched substantially in the direction 8 between an emitter and a receiver of the sensor 23 at about 8 mm upstream from the unstacking head 5 relative to the direction 6 and at a height of about 190 mm from the bottom of the drop-forming feed 11.

FIG. 2 shows a single element of the sensor 23 (emitter or receiver) mounted on a side of the unstacking head that is opposite from the side on which the deformable wheels 10 are disposed. It should be understood that the complementary other element of the sensor 23 is disposed on the other side of the head, and, in this example, on the same side as the inlet cone upstream from the motor-driven deformable wheels 10. The sensor is disposed so as to detect presence of a flat object in said direction indicated by the arrow 8.

The sensor 24 is also a barrier photoelectric cell identical to the sensor 23 but whose emitter and reflector are disposed at a height of about 112 mm relative to the bottom of the drop-forming feed and in a transition zone between the main conveyor belt 2 and the drop-forming feed 11 on either side of the magazine 1. The signal delivered by the sensor 24 indicates presence of postal items in the drop-forming feed.

The sensor 25 can be a mechanical-contact sensor disposed so as to detect presence of the paddle 4 at the transition zone between the main conveyor belt 2 and the drop-forming feed 11.

Finally, FIG. 2 shows two other sensors 26 and 27 (a single component (emitter or receiver) of each of these sensors is shown) that are barrier photoelectric cells disposed vertically one above the other and whose beams are directed in the direction indicated by arrow 6 in order to detect presence of postal items in the inlet cone in the vicinity of and upstream from the deformable wheels 10.

The use of the various sensors is described in more detail below for various situations of inappropriate presentation of the postal items facing the unstacking head.

Figure 3:
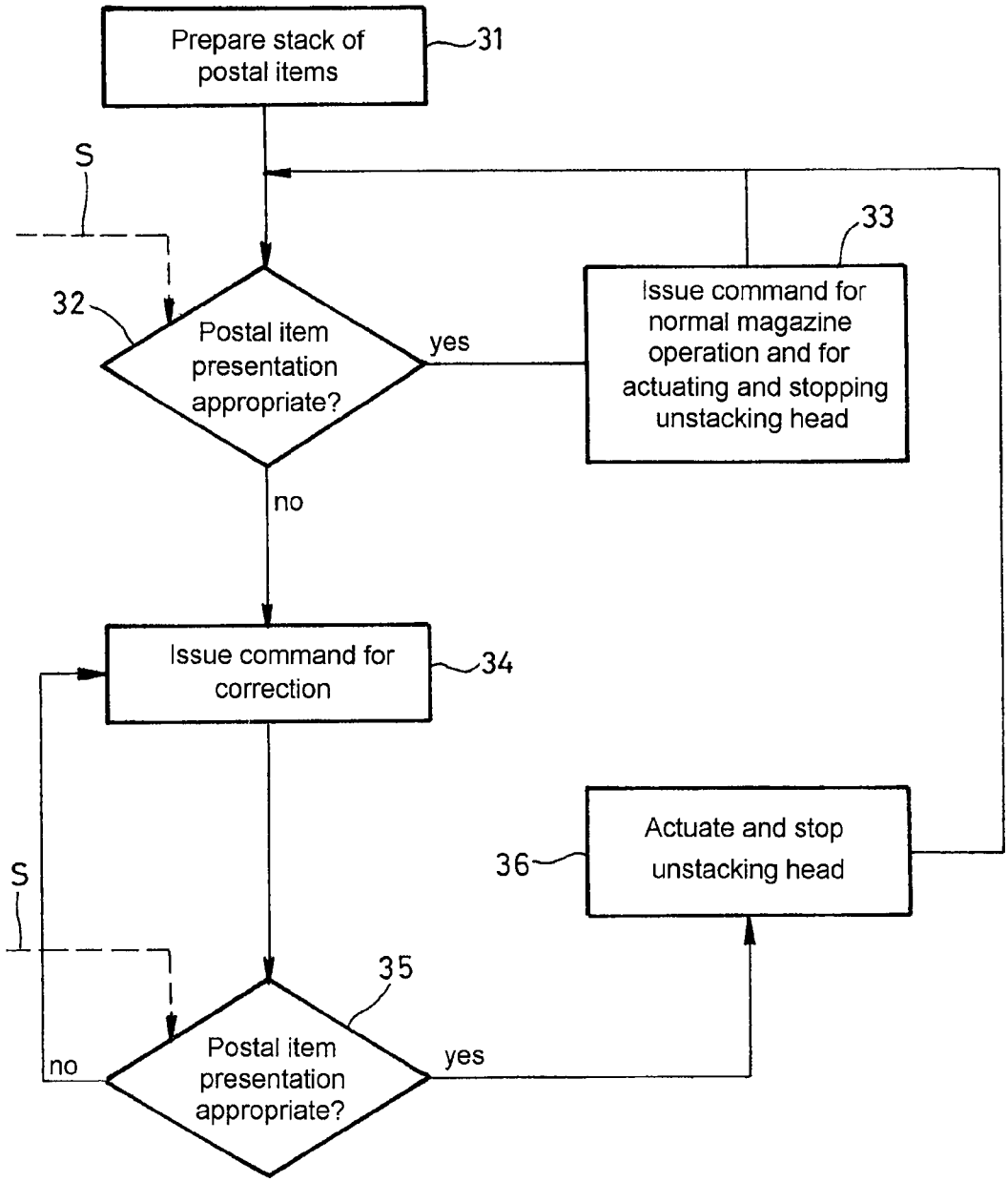
FIG. 3 is a flow chart showing the various steps in the process of checking the signals delivered by the sensors.

FIG. 3 is a simplified flow chart showing how the unstacker device of the invention operates with the sensors and more particularly how the control unit 13 operates.

In preparation step 31, postal items are placed by the operator in a stack and on edge on the main conveyor belt 2 in front of the paddle 4. The control unit actuates all of the motor-driven drives for operation at a constant unstacking rate. The speeds of movement of the conveyor belt 2 and of the paddles 4 are identical. The speed of movement of the conveyor belts 12 is slightly higher than the speed of movement of the conveyor belt 2 or of the paddle. The speed of movement of the belts 9 is much higher than the speed of movement of the conveyor belts 12. By way of example, in normal unstacking mode, the speed of conveyor belt 2 is 0.096 meters per second (m/s), the speed of conveyor belts 12 is 0.152 m/s, and the speed of the perforated belts 9 is 1.5 m/s.

The stack of postal items 3 on edge thus advances towards the unstacking head 5 and first postal items at the front of the stack fall into the drop-forming feed 11. In this example, the stack of postal items is thus fractured and the postal items on edge in the drop-forming feed are fanned out under the action of the faster movement of the conveyor belts 12 in the bottom of the drop-forming feed, and a current first postal item to be unstacked is detected, e.g. by the sensor 23.

At this stage, the process continues with step 32 where the signals S delivered by the sensors are checked by the control unit 13 for determining whether the current postal item to be unstacked has a presentation relative to the unstacking head that is appropriate for said current postal item to be unstacked without any risk of damage or jamming.

If, in step 32, the signals S from the sensors indicate that the presentation of the current postal item is appropriate and that the current time lies within the time window T that is compatible with a constant pitch, then, in step 33, the control unit 13 keeps the conveyor belt 2, the paddle 4, and the conveyor belts 12 in normal unstacking operation, and actuates the motor driven drives for driving the perforated belts 9 and the suction nozzles so as to unstack the postal item. The current postal item is then put into a series by passing between the deformable wheels 10, the motor-driven drives for driving the perforated belts 9 and the suction nozzles are stopped and the process loops back to step 32 for another check on the signals S. In this looped process, the postal items are unstacked at a constant rate of one postal item every 330 milliseconds.

If, in step 32, the signals S delivered by the sensors indicate that the current postal item is inappropriately presented relative to the unstacking head 5, the process continues with step 34 in which the control unit 13 triggers a correction stage for correcting the presentation of the current postal item relative to the unstacking head. It can be understood that, since the motor-driven drives of the perforated belts 9 and of the suction nozzles are stopped, the current postal item is not unstacked.

In order to perform this correction, in accordance with the invention, the control unit 13 controls the motor-driven drives of the conveyor belt 2, of the paddle 4, and of the conveyor belts 12 of the drop-forming feed independently in a manner such as to straighten up the postal items that are in the drop-forming feed 11, and thus such as to correct the presentation of the current postal item to be unstacked.

The manner in which the straightening up is performed is described in detail below.

During the correction stage triggered in step 34, the unit 13 checks, in step 35, the signals S delivered by the sensors to the control unit 13 so as to determine whether the current postal item is then presented appropriately relative to the unstacking head. In practice, the steps 34 and 35 can be performed almost simultaneously.

If, in step 35, the signals S from the sensors indicate that the current postal item to be unstacked is presented appropriately, and that the current time lies within the time window T compatible with a constant pitch between consecutive postal items at the outlet of the unstacking device, then the control unit 13 continues the process with step 36 by actuating the motor-driven drives of the unstacking head (perforated belts and suction belts).

The current postal item to be unstacked is then put in a series between the deformable wheels 10 at the outlet of the unstacking device, the motor-driven drives of the perforated belts 9 and of the suction nozzles are stopped, and normal unstacking operation is resumed. The process then loops back to step 32.

In step 35, if the signals S from the sensors indicate that the current postal item to be unstacked is not presented appropriately and/or that the current time lies outside the time window T, the process loops back to step 34 so as to continue the correction stage or so as to adapt the correction as a function of the signals S.

Therefore, the steps 34 and 35 are repeated as many times as necessary until appropriate presentation of the current item to be unstacked is obtained within the time window T, but preferably, beyond a certain correction time without appropriate presentation being obtained, an alarm is triggered in order to indicate that manual action is necessary.

In accordance with the invention, the current postal item to be unstacked being presented inappropriately relative to the unstacking head 5 is detected on the basis of a check of the signals delivered by the four sensors 20, 21, 22, and 23. The current postal item to be unstacked being presented appropriately is detected on the basis of a check of the signals delivered by the same sensors 20, 21, 22, and 23.

The criteria for determining whether or not the current postal item to be unstacked is presented appropriately relative to the unstacking head can be codified in a truth table as shown in FIG. 12.

FIG. 12 shows said truth table with, on the left, a very diagrammatic representation of the current postal item to be unstacked, seen in profile, in correspondence with the value of the signal delivered by the sensors 20 to 24. A signal at the value of "1" indicates detection of presence of a postal item, whereas a signal at the value of "0" indicates absence of detection of presence of a postal item. The truth table also shows the commands of the motor-driven drives of the conveyor belt 2, of the paddle 4, and of the secondary conveyor belts 12 as a function of the signals delivered by the sensors 20 to 24.

In certain inappropriate presentation situations detected by the sensors, the control unit 13 can react by actuating the motor-driven drive of the unstacking head only if the current postal item is not already engaged in the inlet cone between the deformable wheels 10 (as detected by the sensors 26 and 27). On detecting slumped postal items in the drop-forming feed, it is also possible for the control unit 13 not to actuate the motor-driven drive during the time window T, so as to allow the time necessary for straightening up said postal items by pushing them with the postal items on the main conveyor. If the control unit 13 detects, by means of the sensors, that only the base of the current postal item is improperly presented, it is possible for it not to actuate the motor-driven drive of the unstacking head during the time window T, so that the conveyor belts 12 in the drop-forming feed have time to rectify the presentation of said current postal item.

The process of straightening up the postal items in step 34 of FIG. 3 can be even better understood from the following description of various examples.

Figure 5:
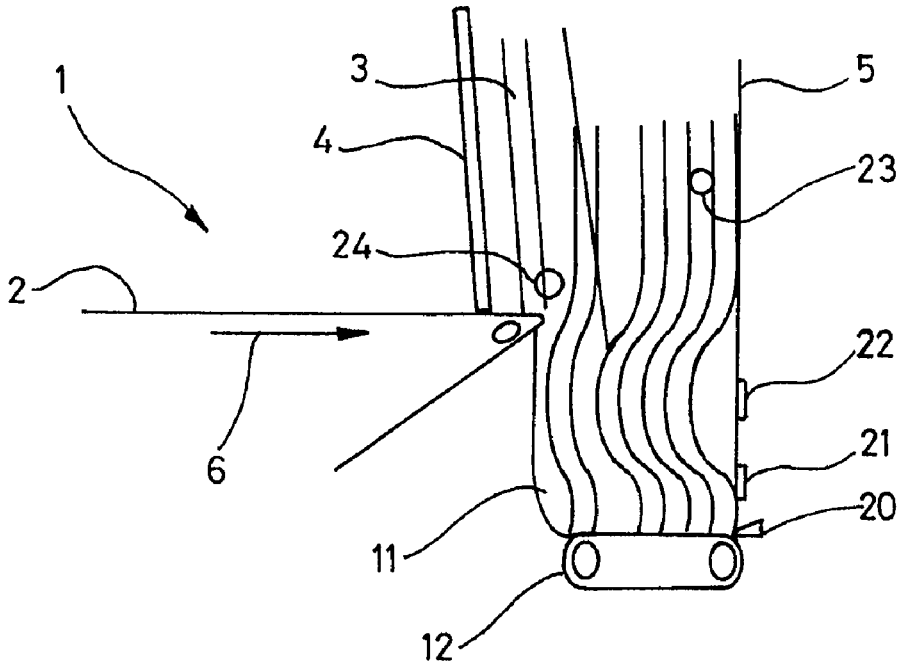
FIG. 5 shows a first situation of inappropriate presentation of the current postal item relative to the unstacking head.

FIG. 5 shows a situation in which the postal items 3 in the drop-forming feed 11 are slumping under their own weight, resulting in the current postal item to be unstacked not bearing fully against the unstacking head 5.

This situation is detected by the control unit 13 by the fact that the sensor 22 generates a signal indicating absence of a postal item while the sensors 20, 21, and 23 generate signals indicating presence of a postal item. This situation corresponds to the third row of the truth table of FIG. 12.

With reference to FIG. 3, for this example, in step 32, the control unit 13 detects inappropriate presentation of the postal item to be unstacked, and, in step 34, causes a correction stage to be preformed for correcting the presentation of the current postal item relative to the unstacking head.

In step 34, the control unit 13 controls the motor-driven drives of the conveyor belt 2 and of the paddle 4 by causing them to go over to slow speed of movement at 0.096 m/s. At the same time, the control unit 13 suspends the motor-driven drive of the conveyor belts 12, since, as indicated by the sensors 20 and 21, the base of the current postal item is bearing correctly against the head 5, thereby straightening up the postal items in the drop-forming feed by means of new postal items arriving from the main conveyor belt 2 by being pushed by the paddle 4.

During the correction stage, the unit 13 checks the signals form the sensors in step 35. In step 35, if the signals S from the sensors indicate that the current postal item to be unstacked is presented appropriately, and that the current time lies within the time window T, the control unit 13 continues the process in step 36 by actuating the motor-driven drive of the unstacking head (perforated belts and suction nozzles).

The current postal item to be unstacked is then put into a series between the deformable wheels 10 at the outlet of the unstacking device, the motor-driven drives of the perforated belts 9 and of the suction nozzles are stopped, and normal unstacking operation is resumed. The process then loops back to step 32.

Conversely, in step 35, if the signals S from the sensors indicate that the current postal item to be unstacked is presented inappropriately, the process loops back to step 34 so as to continue the correction stage or so as to adapt the correction as a function of the signals S.

In a situation (not shown) in which the sensors 21 and 23 deliver signals indicating presence of a postal item while the sensors 20 and 22 deliver signals indicating absence of a postal item, then, in step 34, the control unit 13 controls the conveyor belts 12 so as to cause them to go over to medium speed at 0.152 m/s so as to straighten up the postal items in the drop-forming feed 11. This situation corresponds to the second row of the truth table of FIG. 12.

Another analogous situation would arise with sensors 20, 21, and 22 delivering signals indicating absence of a postal item while sensors 23 and 24 deliver signals indicating presence of a postal item. This situation corresponds to postal items tilting in the left portion of the drop-forming feed in FIG. 5. In which case, the control unit 13, in step 34, controls the conveyor belts 12 so as to cause them to go over to medium speed at 0.152 m/s, and controls the motor-driven drives of the conveyor belt 2 and of the paddle 4 by causing them to go over to slow speed of movement at 0.096 m/s. This situation corresponds to the fourth row of the truth table of FIG. 12.

A particular situation would arise with sensors 21 and 22 delivering signals indicating absence of a postal item while sensors 20, 23, and 24 are delivering signals indicating presence of a postal item. In which case, the control unit 13, in step 34, controls the conveyor belts 12 so as to cause them to go over to medium speed in reverse at 0.152 m/s, and controls the motor-driven drives of the conveyor belt 2 and of the paddles 4 by causing them to go over to slow speed of movement at 0.096 m/s. This situation corresponds to the fifth row of the truth table of FIG. 12.

Figure 6:
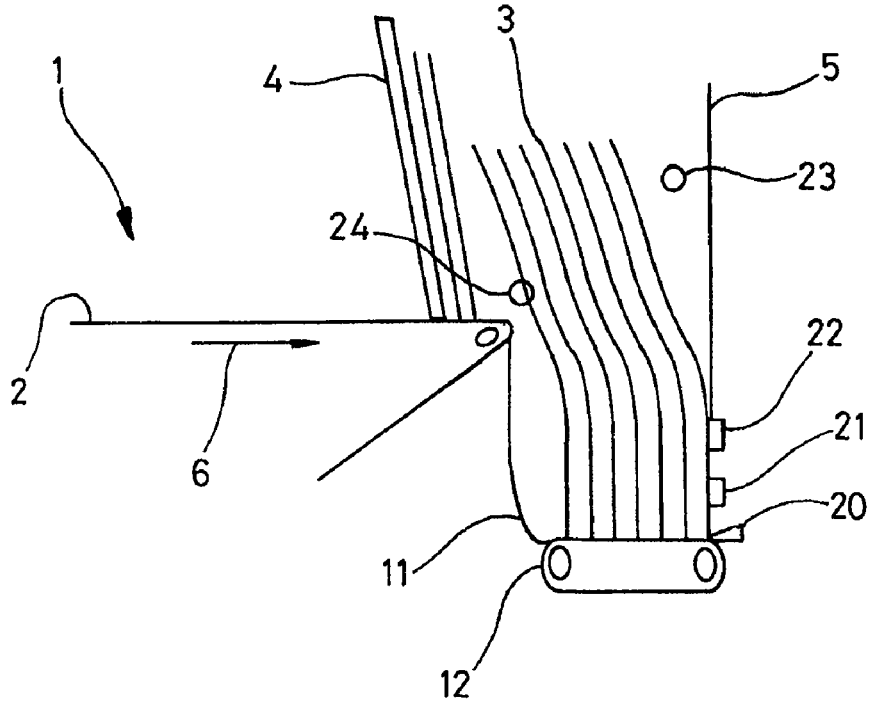
FIG. 6 shows a second situation of inappropriate presentation of the current postal item relative to the unstacking head.

FIG. 6 shows another situation of the current postal item to be unstacked being presented inappropriately relative to the unstacking head. In this situation, the postal items in the drop-forming feed 11 are flopping backwards at their tops, which results in sensors 20, 21, and 22 delivering signals indicating presence of a postal item but in sensor 23 delivering a signal indicating absence of a postal item. This situation corresponds to the seventh row of the truth table of FIG. 12.

In the example of FIG. 6, sensor 24 detects presence of a postal item. In step 32, the control unit 13 thus detects an inappropriate presentation of the current postal item relative to the unstacking head 5. In step 34, the control unit 13 triggers a correction stage consisting simultaneously in interrupting the drive of the conveyor belt 2 for 25 milliseconds, in causing the speed of movement of the paddle to go over to slow speed at 0.096 m/s, and in interrupting the drive of conveyor belts 12 in the drop-forming feed. After a time delay of 25 milliseconds, the unit 13 causes the speed of the conveyor belt 2 to go over to 0.096 m/s.

This correction stage generates an offset between the paddle 2 and the conveyor belt 2 straightening up the tops of the postal items both on the main conveyor belt 2 and in the drop-forming feed 11.

During the correction stage, the unit 13 checks, in step 35, whether the signals S from the sensors indicate that the current postal item is presented appropriately, and whether the current time lies within the time window T. In which case, in step 36, the control unit 13 actuates the motor-driven drive of the unstacking head and continues the process as described above.

Conversely, in step 35, if the signals S from the sensors indicate that the current postal item is inappropriately presented, the process loops back to the step 34 so as to continue the correction stage or so as to adapt the correction as a function of the signals S.

Figure 7:
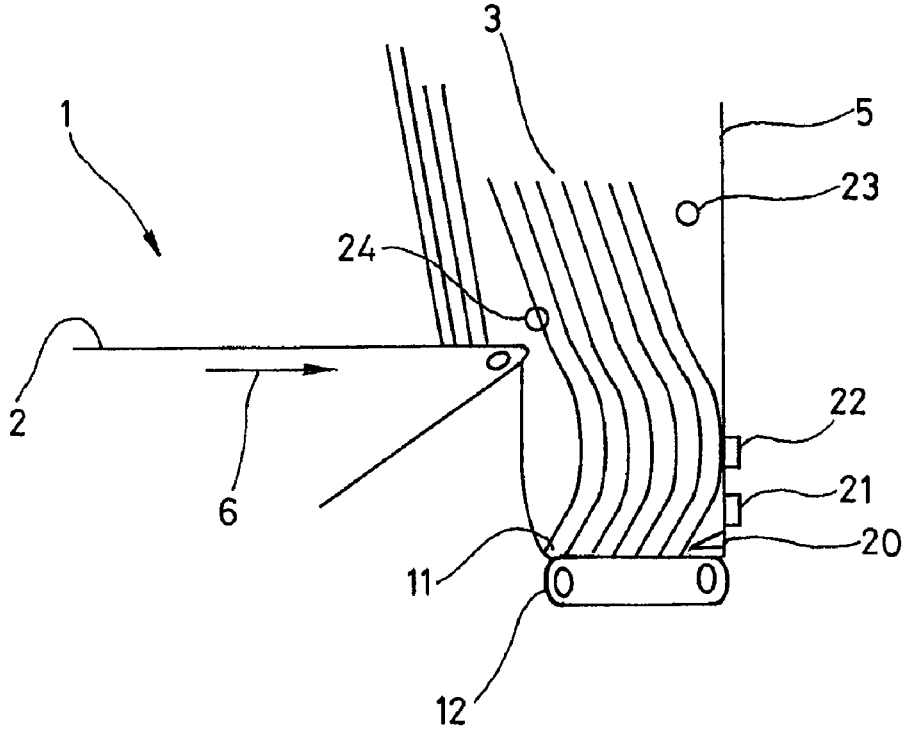
FIG. 7 shows a third situation of inappropriate presentation of the current postal item relative to the unstacking head.

FIG. 7 shows another example of the current item to be unstacked being inappropriately presented relative to the unstacking head. In this example, the tops of the postal items in the drop-forming feed are slumping backwards and, at the same time, the bases of the postal items in the drop-forming feed are slipping backwards.

In this situation, sensors 20 and 23 deliver signals indicating absence of a postal item while sensors 21, 22, and 24 deliver signals indicating presence of a postal item. This situation corresponds to the sixth row of the truth table of FIG. 12.

In step 34, the control unit 13 triggers a correction stage consisting in suspending the drive of the conveyor belt 2 for 25 milliseconds, and then causes the speed of the conveyor belt 2 to go over to 0.096 m/s. At the same time, the speed of movement of the paddle 4 is caused to go to slow speed at 0.096 m/s while the speed of the conveyor belts 12 is caused to go to medium speed at 0.152 m/s. This results both in straightening up the tops of the postal items in the drop-forming feed and, at the same time, in causing the bases of the postal items to advance towards the unstacking head.

During the correction stage, the unit 13 checks, in the step 35, whether the signals S from the sensors indicate that the postal item is presented appropriately, and that the current time lies within the time window T, and the process continues as described above.

Figure 8:
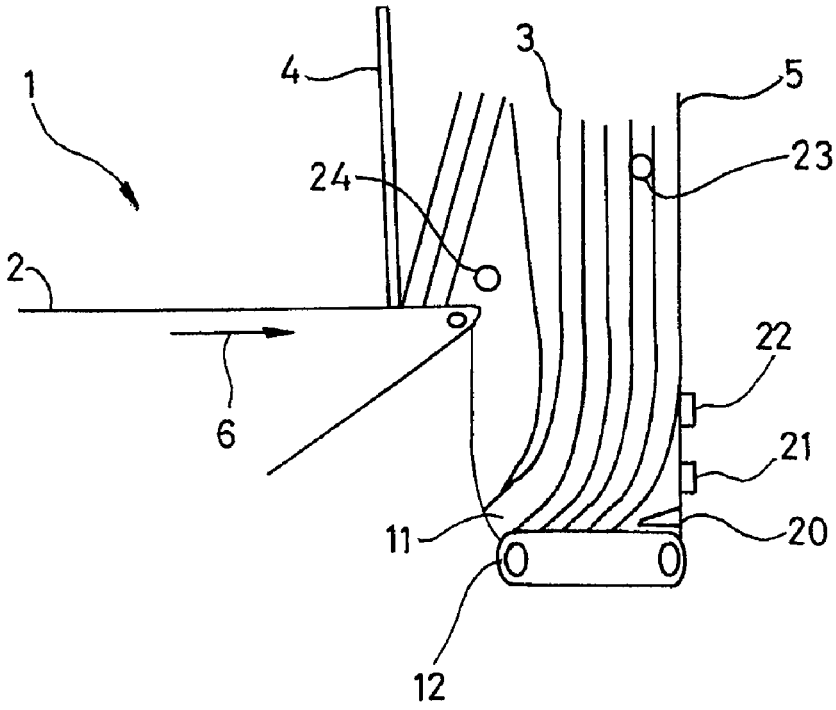
FIG. 8 shows a fourth situation of inappropriate presentation of the current postal item relative to the unstacking head.

FIG. 8 shows another example of the postal item to be unstacked being presented inappropriately relative to the unstacking head. In this example, the bases of the postal items in the drop-forming feed are set back relative to the unstacking head. Sensors 20 and 21 deliver signals indicating absence of a postal item, while sensors 22 and 23 deliver signals indicating presence of a postal item. Sensor 24 also delivers a signal indicating absence of a postal item in the drop-forming feed. In which case, the drop-forming feed is insufficiently fed with postal items. This situation corresponds to the ninth row of the truth table of FIG. 12.

In step 34, the control unit 13 triggers a correction stage consisting in causing the conveyor belt 2 and the paddle 4 to go over to slow speed at 0.096 m/s while the conveyor belts 12 are caused to go over to medium speed at 0.152 m/s.

This also results in the drop-forming feed 11 being fed with postal items by packing the postal items more tightly in the drop-forming feed. As a result, the postal item to be unstacked is straightened up.

Figure 9:
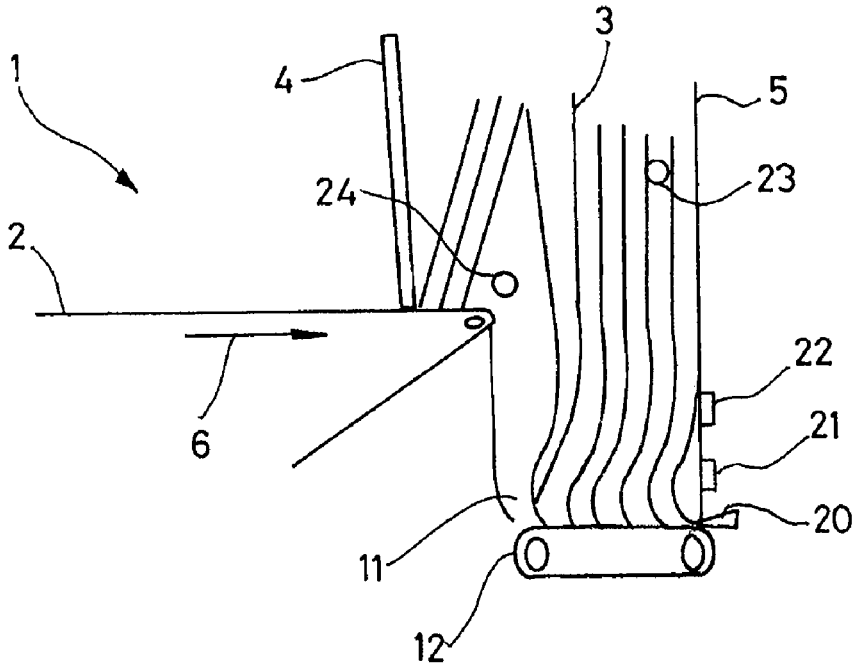
FIG. 9 shows a fifth situation of inappropriate presentation of the current postal item relative to the unstacking head.

FIG. 9 shows yet another example of inappropriate presentation of the current postal item relative to the unstacking head.

In this example, sensors 21 and 24 deliver signals indicating absence of a postal item while sensors 20, 22, and 23 deliver signals indicating presence of a postal item. This situation corresponds to the tenth row of the truth table of FIG. 12.

In step 34, the control unit 13 causes the paddle 4 and the conveyor belt 2 of the main magazine to go over to slow speed at 0.096 m/s, while it causes the conveyor belts 12 to move in reverse at the medium speed of 0.152 m/s.

This results both in feeding the drop-forming feed 11 with postal items, and also in moving the bases of the postal items that are already present in the drop-forming feed 11 backwards, thereby straightening up all of the postal items in the drop-forming feed 11.

Figure 10:
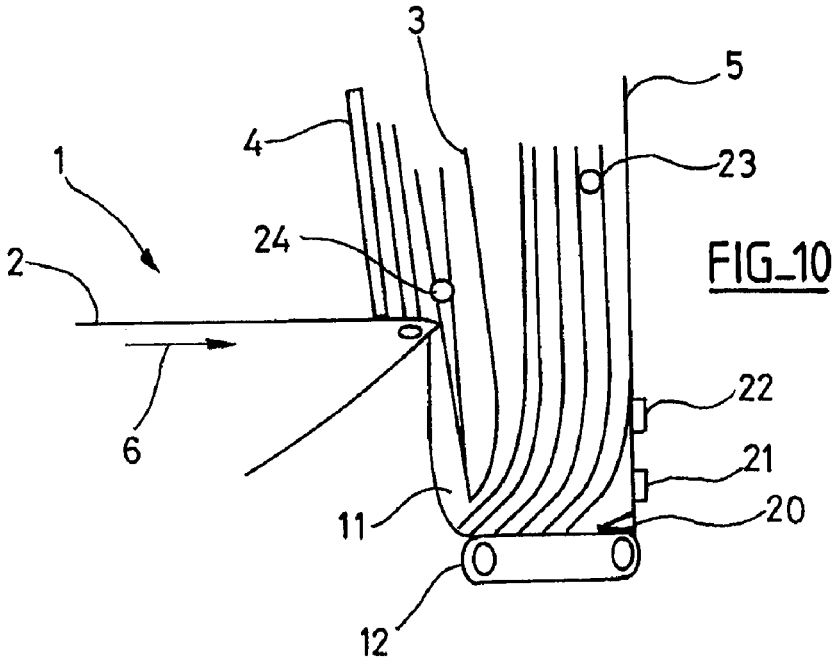
FIG. 10 shows a sixth situation of inappropriate presentation of the current postal item relative to the unstacking head.

FIG. 10 shows yet another example of the current postal item to be unstacked being presented inappropriately relative to the unstacking head.

In this example, sensors 20, 21 deliver signals indicating absence of a postal item while sensors 22, 23, and 24 deliver signals indicating presence of a postal item. This situation corresponds to the eleventh row of the truth table of FIG. 12.

In this example, the drop-forming feed is overfed with postal items whose bottoms slip back.

In step 34, the control unit 13 causes the conveyor belt 2 and the paddle 4 to go over to slow speed at 0.096 m/s for 25 milliseconds and then interrupts operation of them. At the same time, the control unit causes the conveyors 12 to go over to medium speed at 0.152 m/s so as to straighten up the postal items in the drop-forming feed, without feeding the drop-forming feed with any more postal items.

Figure 11:
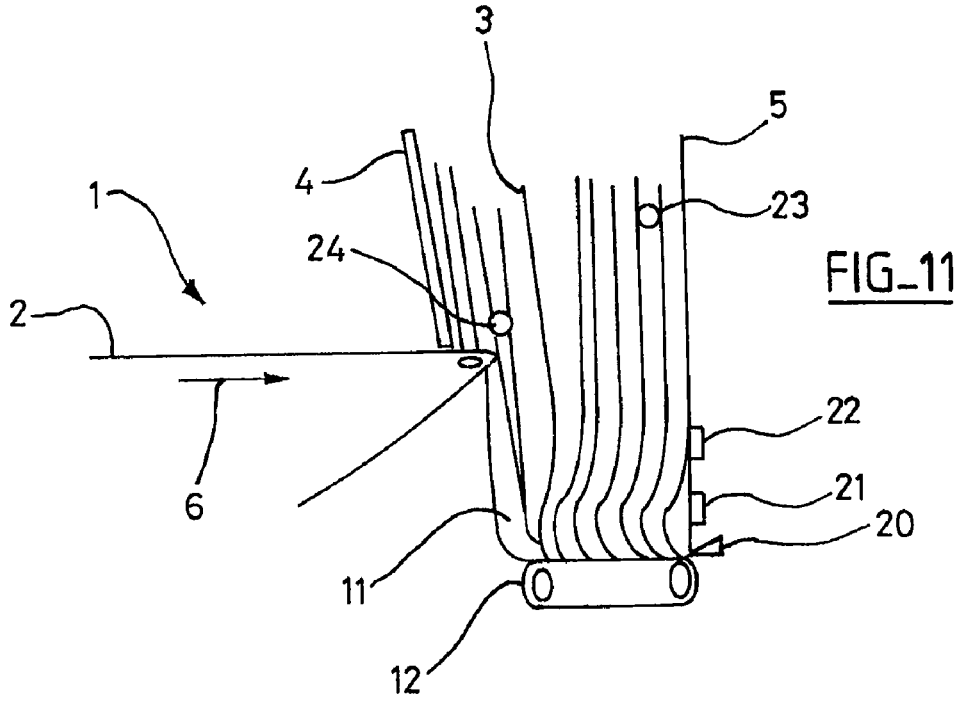
FIG. 11 shows a seventh situation of inappropriate presentation of the current postal item relative to the unstacking head.

In FIG. 11, the presentation of the postal items is analogous to the situation in FIG. 10, but the bases of the postal items are slipping forwards. Sensor 21 delivers a signal indicating absence of a postal item while sensors 20, 22, 23, and 24 deliver signals indicating presence of a postal item. This situation corresponds to the twelfth row of the truth table of FIG. 12.

In this situation, the control unit 13 causes the conveyor belt 2 and the paddle 4 to go over to slow speed for 25 milliseconds and then interrupts operation of them. At the same time, it causes the conveyor belts 12 to go over to reverse at the speed of 0.152 m/s so as to straighten up the postal items in the drop-forming feed.

Naturally, the invention is not limited to the embodiment of the unstacker device that is described above. In particular, it is possible, while remaining within the ambit of the invention, to modify the details of the sensors, to modify the number and the positions of the sensors, and to apply different corrections in response to the signals delivered by the sensors.

What is claimed is:

1. An unstacker device for unstacking flat objects, which device comprises a motor-driven feed magazine controlled so as to move flat objects in a stack and on edge facing an unstacking head provided with a motor-driven drive having a perforated belt and a suction chamber, which motor-driven unstacking head drive is actuated so as to separate a current first object from the stack and so as to eject it in a direction that is transverse to the direction in which the stack of flat objects is moved, in which device the motor-driven unstacking head drive is actuated and stopped each time a current object is unstacked, and the stack of flat objects is straightened up in the magazine in response to detection of signals delivered by a plurality of sensors disposed in the unstacking head, a first sensor being disposed to detect presence of a bottom portion of the current object facing the unstacking head, a second sensor being disposed to detect presence of a first intermediate portion of the current object facing the unstacking head, said first intermediate portion being situated above said bottom portion of the current object, wherein a third sensor is disposed to detect presence of a second intermediate portion of the current object facing the unstacking head, said second intermediate portion being situated above said first intermediate portion of the current object, said sensors being disposed in the unstacking head in a manner such as to deliver signals indicating that said current object is presented appropriately relative to the unstacking head, wherein said unstacker device further comprises a control unit connected with said sensors, said control unit being programmed for actuating the drive of the unstacking head so as to separate a current first object from the stack if the signals indicate that the current object is presented appropriately and for stopping the drive of the unstacking head if the signals indicate that the current object is presented inappropriately.

2. An unstacker device according to claim 1, in which the unstacking head comprises a metal sheet provided with two openings side-by-side.

3. An unstacker device according to claim 1, in which the first sensor is a flag mechanical sensor, the second sensor is a reflection optical sensor, and the third sensor is a reflection optical sensor.

4. An unstacker device according to claim 2, in which the first, second, and third sensors are aligned vertically in the unstacking head between said two openings.

5. An unstacker device according to claim 1, in which said plurality of sensors further includes a fourth sensor disposed to detect presence of a flat object in said direction that is transverse to the direction in which the stack of flat objects moves.

6. An unstacker device according to claim 5, in which said fourth sensor is an optical barrier sensor.

7. An unstacker device according to claim 1, in which the feed magazine comprises a drop-forming feed disposed between a main conveyor belt with a motor-driven drive and the unstacking head, and a paddle with a motor-driven drive, said paddle being suitable for being moved along the main conveyor belt, the drop-forming feed being provided with secondary conveyor belts with a motor-driven drive, the control unit acting on the motor-driven drives of the main conveyor belt, of the paddle, and of the secondary conveyor belts so as to present the current object appropriately relative to the unstacking head.

8. An unstacker device according to claim 7, in which the control unit is arranged to change the speeds and the directions of the motor-driven drives of the feed magazine in order to present the current object appropriately relative to the unstacking head.

9. An unstacker device according to claim 8, in which the control unit is arranged to trigger an alarm at the end of a certain time for which the control unit has been acting on the motor-driven drives of the main conveyor belt, of the paddle, and of the secondary conveyor belts without obtaining appropriate presentation of the current object relative to the unstacking head.

10. A machine for handling postal items, said machine including an unstacker device according to claim 1.

11. An unstacker device for unstacking flat objects, which device comprises a motor-driven feed magazine controlled so as to move flat objects in a stack and on edge facing an unstacking head provided with a motor-driven drive having a perforated belt and a suction chamber, which motor-driven drive is actuated so as to separate a current first object from the stack and so as to eject it in a direction that is transverse to the direction in which the stack of flat objects is moved, in which device the motor-driven drive is actuated and stopped each time a current object is unstacked, and the stack of flat objects is straightened up in the magazine in response to detection of signals delivered by a plurality of sensors disposed in the unstacking head, a first sensor being disposed to detect presence of a bottom portion of the current object facing the unstacking head, a second sensor being disposed to detect presence of a first intermediate portion of the current object facing the unstacking head, said first intermediate portion being situated above said bottom portion of the current object, wherein a third sensor is disposed to detect presence of a second intermediate portion of the current object facing the unstacking head, said second intermediate portion being situated above said first intermediate portion of the current object, said sensors being disposed in the unstacking head in a manner such as to deliver signals indicating that said current object is presented appropriately relative to the unstacking head, and wherein the drive of the unstacking head is actuated if the signals indicate that the current object is presented appropriately, wherein the feed magazine comprises a drop-forming feed disposed between a main conveyor belt with a motor-driven drive and the unstacking head, and a paddle with a motor-driven drive, said paddle being suitable for being moved along the main conveyor belt, the drop-forming feed being provided with secondary conveyor belts with a motor-driven drive, the control unit acting on the motor-driven drives of the main conveyor belt, of the paddle, and of the secondary conveyor belts so as to present the current object appropriately relative to the unstacking head, and wherein the control unit is arranged to change the speeds and the directions of the motor-driven drives of the feed magazine in order to present the current object appropriately relative to the unstacking head, and wherein the control unit is arranged to trigger an alarm at the end of a certain time for which the control unit has been acting on the motor-driven drives of the main conveyor belt, of the paddle, and of the secondary conveyor belts without obtaining appropriate presentation of the current object relative to the unstacking head.

* * * * *